United States Patent [19]

Wessel et al.

[11] 4,170,967

[45] Oct. 16, 1979

[54] APPARATUS FOR CONTROLLING THE MIXTURE OF AN INTERNAL COMBUSTION ENGINE

[75] Inventors: Wolf Wessel, Oberriexingen; Gerhard Stumpp, Stuttgart, both of Fed. Rep. of Germany

[73] Assignee: Robert Bosch GmbH, Stuttgart, Fed. Rep. of Germany

[21] Appl. No.: 952,905

[22] Filed: Oct. 19, 1978

Related U.S. Application Data

[63] Continuation of Ser. No. 764,323, Jan. 31, 1977, abandoned.

[30] Foreign Application Priority Data

Feb. 4, 1976 [DE] Fed. Rep. of Germany ..... 2604160

[51] Int. Cl.[2] ..... F02B 3/00

[52] U.S. Cl. ..... 123/32 EE; 123/119 EC

[58] Field of Search ..... 123/32 EE, 32 EJ, 119 E, 123/119 EC; 60/276, 285

[56] References Cited

U.S. PATENT DOCUMENTS

| | | | |
|---|---|---|---|
| 3,616,274 | 10/1971 | Eddy | 60/276 |
| 3,730,686 | 5/1973 | Breitenbach et al. | 60/276 |
| 3,868,819 | 3/1975 | Knapp | 60/276 |
| 3,875,907 | 4/1975 | Wessel et al. | 60/276 |
| 3,915,135 | 10/1975 | Kushida et al. | 123/32 EE |
| 3,926,154 | 12/1975 | Williams | 60/276 |
| 3,938,479 | 2/1976 | Oberstadt | 123/32 EE |
| 4,027,477 | 6/1977 | Storey | 60/276 |
| 4,029,061 | 6/1977 | Asano | 60/276 |
| 4,030,462 | 6/1977 | Sajayama et al. | 123/119 EC |
| 4,112,893 | 9/1978 | Anzai | 123/32 EE |

*Primary Examiner*—Charles J. Myhre
*Assistant Examiner*—R. A. Nelli
*Attorney, Agent, or Firm*—Edwin E. Greigg

[57] ABSTRACT

The fuel mixture of an engine is controlled by a mechanism responsive to the signals from an oxygen sensor located in the exhaust pipe. The oxygen sensor is provided with a heater to permit rapid attainment of normal operating temperatures. The heater is controlled by a switch actuated by a timing circuit. The timing circuit closes the switch whenever the alternating signals from a comparator responsive to sensor signals do not occur, indicating sensor non-operation.

3 Claims, 1 Drawing Figure

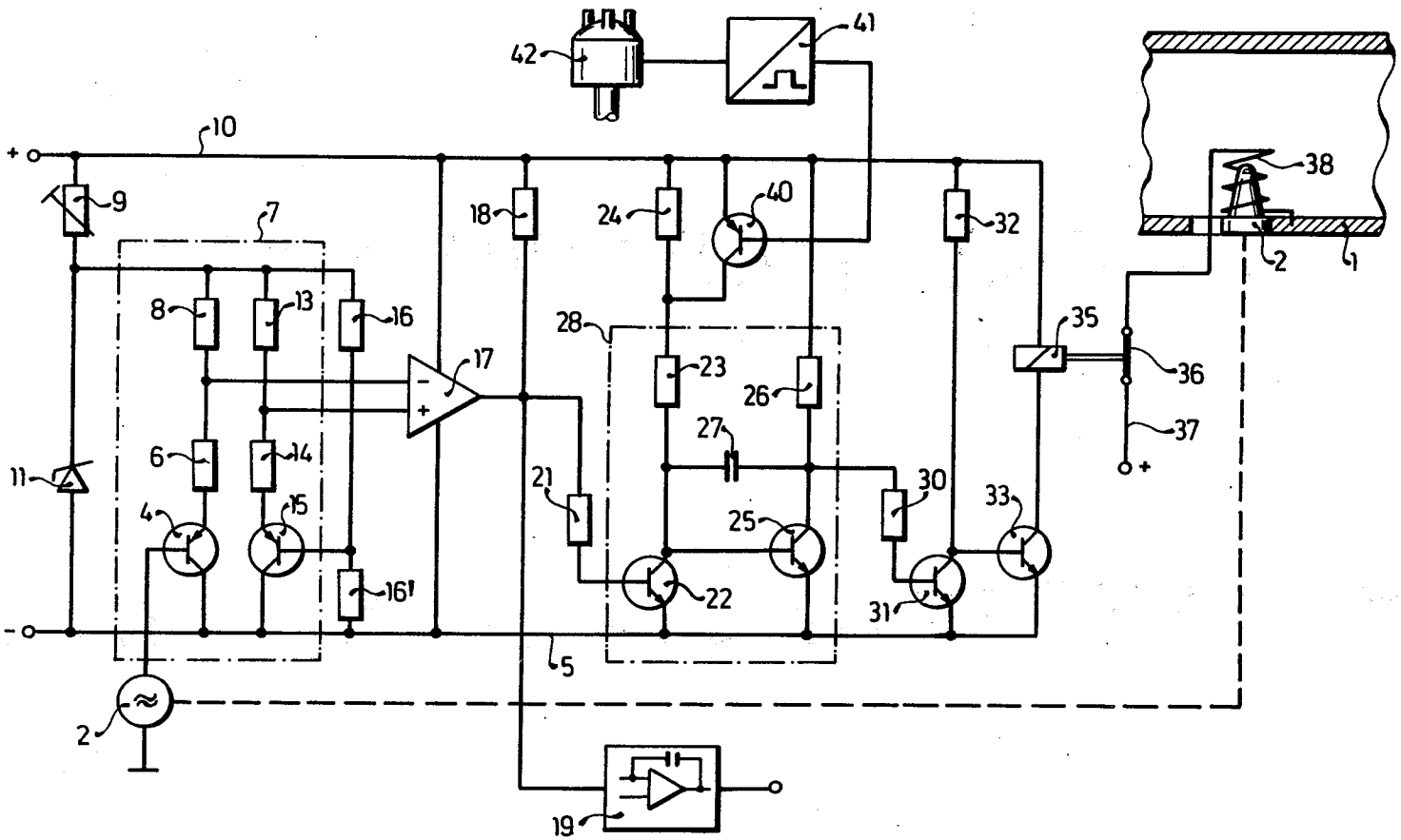
1
2
38
36
37
+
35
32
33
30
31
41
40
26
25
27
23
22
24
28
21
5
42
18
19
17
16
16'
13
14
15
7
10
8
6
4
9
11
2
+
-

APPARATUS FOR CONTROLLING THE MIXTURE OF AN INTERNAL COMBUSTION ENGINE

This is a continuation of application Ser. No. 764,323 now abandoned filed Jan. 31, 1977.

BACKGROUND OF THE INVENTION

The invention relates to a controller for adjusting the operational combustion mixture fed to an internal combustion engine. The controller includes an oxygen sensor and a threshold switch actuated thereby as well as a timing element which generates alternating signals during normal operation and thereby controls a switch to move from a first to a second switching position.

The mixture control to which this invention relates is superimposed on the basic mixture preparation which takes place by means of a carburetor or another system, for example an electronically controlled induction tube injection system. It is the purpose of the present apparatus to use the information provided by the oxygen sensor to maintain the fuel-air mixture fed to the engine at a concentration slightly sub-stoichiometric, i.e., somewhat leaner than the stoichiometric value. Such a mixture results in a particularly favorable exhaust gas composition, especially regarding toxic components. In addition, a fuel-air mixture of this composition permits a catalytic reactor to process the exhaust gases of the engine in a favorable manner.

On the other hand, a control system of this type functions satisfactorily only if the signal generated by the oxygen sensor provides a useable signal. A useable signal is obtained when the oxygen sensor is heated to a temperature exceeding 400° C. If the temperature is substantially less, the resistance of the solid electrolyte, which produces the sensor signal based on the principle of ion conduction and whenever there is present a partial pressure of oxygen, becomes so large that the sensor is no longer able to generate a signal useable for control. This condition obtains, for example, during the warm-up phase of the engine operation. However, in overrunning operation, i.e., during engine braking, or even during extended idling, the exhaust gas temperature may decline so that the minimum operational temperature of the oxygen sensor is no longer attained.

It is known in the control system described above to trigger a warning device or some other mechanism for changing the operation of the engine when the alternating output signals of the oxygen sensor are found to be absent or are otherwise disturbed. It is also known to employ a thermal transducer which is located directly adjacent to the oxygen sensor and which controls the operation of a heating coil for heating the sensor. Such supplementary heating warms up the sensor to its minimum temperature. This system has the disadvantage that the temperature sensor must operate at temperatures far in excess of 400° C. and is relatively expensive. Furthermore, the sensor must operate in the difficult environment found in the exhaust gas of an internal combustion engine and quickly deteriorates.

OBJECT AND SUMMARY OF THE INVENTION

It is a principal object of the invention to provide an apparatus for switching on a heater for an oxygen sensor when the oxygen sensor is at a temperature below its operational temperature. This object is attained, according to the invention, by providing an integrating timing element actuated by a transistor, itself triggered by signals from the oxygen sensor. A switching device is actuated by the integrating timing element and switches on a heater associated with the oxygen sensor. In advantageous manner, the absence of control signals which an oxygen sensor normally generates is used to switch on the heating of the sensor. A further advantage deriving from the apparatus of the invention is that a temperature sensor may be entirely dispensed with.

In a favorable feature of the invention, a transistor switch is triggered by pulses occurring at the frequency of the speed of operation of the engine. In this manner, the actuation of the integrator is limited to a period of time during which the transistor switch is turned on by pulses of constant width and rpm-dependent frequency. If the alternating output signal of the threshold switch or the sensor is missing, the time elapsing until the heater is turned on may be made rpm-dependent so that at high engine speeds, the heating may occur sooner. As a result, the functional and response reliability at high rpms is increased which is also favorable because of the more rapid alternation of the output signals of the sensor and higher rpm. Thus a drop in the operational temperature of the sensor may be sensed very quickly.

The invention will be better understood as well as further objects and advantages thereof become more apparent from the ensuing detailed description of a preferred embodiment taken in conjunction with the drawing.

BRIEF DESCRIPTION OF THE DRAWING

The single FIGURE of the drawing is a schematic diagram of a control circuit according to the invention for actuating a heating element for a oxygen sensor.

DESCRIPTION OF THE PREFERRED EMBODIMENT

Turning now to the drawing, there is seen a part of an exhaust pipe 1 of an internal combustion engine, not further shown. Mounted within the exhaust pipe is a per se known oxygen sensor 2 which operates on the principle of ion conduction through a solid electrolyte. If the oxygen concentration, i.e., the partial pressure of oxygen prevailing on the side of the electrolyte exposed to the exhaust gas differs from the oxygen concentration on the other side exposed to a reference medium, the sensor generates a voltage signal which changes abruptly when the air factor $\lambda$ crosses the value $\lambda=1$. Such sensors are known and have been described in numerous places. A disadvantage of these sensors is the fact that ion conduction through the solid electrolyte of sufficient magnitude to generate a clear voltage signal occurs only when operational temperatures of approximately 400° C. have been reached. If the temperatures are lower, the internal resistance of the sensor is too large. An oxygen sensor of the type employed in this invention is indicated symbolically in the FIGURE. The same oxygen sensor is shown again as a voltage source 2. The signal from this sensor is fed to the base of a transistor 4 whose collector is connected to a common supply line 5 and whose emitter is coupled with a resistor 6. The collector-emitter path of the transistor 4 and the series resistor 6 constitute the first branch of a bridge circuit 7. Connected in series with this first branch is a resistor 8 which is connected to a further series resistor 9 to a common positive supply bus 10. Connected in parallel to the first branch formed by the transistor 4 and the resistor 6 is a Zener diode 11. Further connected in parallel to the resistor 8 is a resistor 13 lying in a third branch of the bridge circuit 7. In series therewith a fourth branch of the bridge includes an emitter-resistor 14 connected to the emitter-collector path of a transistor 15, the collector of which is connected to the common supply line 5. The base of the transistor 15 is connected to the junction of a voltage divider made up from series resistors 16 and 16' which is connected in parallel to the third and fourth branches of the bridge circuit 7. The diagonal bridge connection is connected across the inputs of an operational amplifier 17. The junction of resistors 8 and 6 is connected to the inverting input of the amplifier and the junction of resistors 13 and 14 is connected to the non-inverting input of the operational amplifier 17.

The output of the operational amplifier is connected via a resistor 18 to the common supply line 10 and is further coupled to a control amplifier 19 having integral characteristics. The connection to the control amplifier 19 is a known regulating circuit the output of which controls a final control element, not shown, for changing the fuel-air mixture of the engine.

The operation of the circuit described so far is as follows. The output signal of the oxygen sensor 2 is fed to the transistor 4 in the first branch of the bridge circuit 7. This signal which contains information regarding the oxygen content of the exhaust gases is the actual value of the control loop. The set point value, i.e., the value of the air factor $\lambda$ to which the fuel-air mixture is to be adjusted, is obtained as a voltage stabilized by the Zener diode 11 and is fed from the voltage divider 16 and 16' to the base of the transistor 15. The junction of resistors 13 and 14 carries a corresponding constant reference potential which is compared with the voltage at the junction of resistors 8 and 6, which varies in accordance with the sensor voltage, by means of the operational amplifier 17. This amplifier 17 serves as a threshold switch, the output of which is a positive or negative signal equal in magnitude to the potential of the supply lines 5 and 10, depending on whether the actual value is higher or lower than the set point value. These positive and negative signals are fed to the control amplifier 19 for further processing. Due to the dead time of the control loop consisting of the oxygen sensor, the mixture control mechanism, the engine itself and back to the oxygen sensor, the actual exhaust gas concentrations are constantly exhibiting a changing oxygen content. Thus if the operational values of the mixture are regulated to air factors of the value $\lambda=1$, the oxygen sensor generates a steadily alternating signal related to the alternating excess and shortage of oxygen. The frequency of these alternations increases with the rpm of the engine. The corresponding alternating potential at the output of the operational amplifier 17 is used by the control amplifier 19 which integrates it in one or the other directions and actuates the final control element in the proper manner for changing the fuel-air mixture.

The output of the operational amplifier 17 is further connected through a resistor 21 to the base of an NPN-transistor 22, the emitter of which is connected to the supply line 5 and the collector of which is connected through a resistor 23 and a resistor 24 to the common supply line 10. The collector of the transistor 22 is further connected to the base of a transistor 25, the emitter of which is connected to the line 5 and the collector of which is connected through a resistor 26 to the line 10. The collectors of transistors 22 and 25 are joined through a capacitor 27. The just described circuit including transistors 22 and 25, resistors 23 and 26 and the capacitor 27 represents a per se known Miller integrating circuit 28, the output of which, at the collector of the transistor 25, is connected through a resistor 30 to the base of a further transistor 31. The transistor 31 is connected as an emitter-follower and its collector is connected to the base of a power transistor 33, the emitter of which is connected to line 5 and the collector of which is connected through the coil of a relay 35 to the line 10. A collector-resistor 32 lies between the collector of the transistor 31 and the supply line 10.

The relay 35 actuates a switch 36 which interrupts the supply of power for a heater 38 associated with the oxygen sensor 2. Preferably, the heater is a heating coil which tightly surrounds the oxygen sensor. One end of the heating coil is grounded to the exhaust pipe whereas the other end is fed through the exhaust pipe wall in insulating manner to a positive source of potential, for example the vehicle battery.

Parallel to the resistor 24 in the collector line of the transistor 22 is a transistor 40, the base of which is controlled by a pulse transformer 41. The pulse transformer 41 receives rmp-dependent pulses, for example from the distributor 42 of the engine, which are transformed thereby into rectangular pulses of constant width and of rmp-dependent frequency.

The above-described circuit operates in the following manner. When the oxygen sensor is operational, the output of the operational amplifier 17 generates a signal which steadily alternates between high potential (H) and low potential (L). Each occurrence of the H potential renders the transistor 22 conducting and after a short recharging time of the capacitor 27, the base of the transistor 25 receives the low potential of the supply line 5 causing it to block. As a consequence, the collector of the transistor 25 becomes positive and the base of the transistor 31 receives a signal which is positive with respect to the supply line 5, causing it to conduct. Thus the base of the transistor 33 is brought to the potential of the line 5, blocking the transistor 33 and interrupting the current through the relay 35. As a result, the switch 36 is opened and the heater is turned off.

If an L potential is fed to the base of the transistor 22, this transistor blocks. From this point on, the Miller integrator 28 begins to function. Let it be assumed that the transistor 40 is in its conducting state. The previously charged capacitor 27 may now discharge through the resistor 23 and the transistor 25. The discharge time is determined by the magnitude of the resistor 23. As the capacitor 27 discharges, the base of the transistor 25 becomes more positive until the transistor 25 becomes completely conducting thereby blocking the transistor 31. The transistor 33 becomes conducting due to the positive potential present at its base. The relay 35 then operates and closes the switch 36.

Thus, if no new H potential occurs during the discharge time determined by the resistor 23 and the capacitance of the capacitor 27, to cause the transistor 22 to conduct, the heating circuit of the heater is closed thereafter. However, if prior to the expiration of this time the L potential at the base of the transistor 22 changes back to an H potential, the transistors 25 and 33 remain blocked and the switch 36 open. In this circuit, the time constant of the Miller integrator is so chosen that when the oxygen sensor is in normal operation, the output signal would always alternate prior to the expiration of this period so that, in a normal situation, the transistors 25 and 33 would be constantly blocked.

Thus, the circuit starts to heat a cold oxygen sensor as soon as the control is turned on and turns off the heating process as soon as the sensor generates control signals which alternate at a sufficiently rapid rate.

The circuit would operate in principle even if the resistor 24 and the transistor 40 were replaced by a direct connection between the resistor 23 and the supply line 10. However, the presence of the transistor 40 and the use of the pulse transformer 41 permit an rpm-dependent adjustment of the time constant of the Miller integrator. The transistor 40 is turned on and off at an rpm-dependent frequency. During the time periods when the transistor 40 is blocked, the discharge process takes place only relatively slowly through the additional resistance 24. When the transistor conducts, the discharge process occurs faster so that an overall step-shaped, delayed, discharge characteristic takes place. At increasing rpm, the time during which the transistor 40 conducts is increased per unit time so that, at high rpm, when a normally operating oxygen sensor generates a faster sequence of signals, the time constant of the Miller integrator is reduced by comparison with the operation at lower rpm. This fact brings the advantage that a cold condition of the oxygen sensor is rapidly sensed in all operational domains of the engine and the heater can be immediately turned on.

Instead of the relay, a variant embodiment of the circuit may provide that the heater is a collector resistor lying in the emitter-collector path of the transistor 33.

The foregoing relates to preferred embodiments of the invention, it being understood that other embodiments and variants are possible within the spirit and scope of the invention, the latter being defined by the appended claims.

What is claimed is:

1. An apparatus for controlling the fuel-air mixture of an internal combustion engine, comprising:

an oxygen sensor, located in the exhaust system of the engine;

a comparator circuit, connected to said oxygen sensor and connectable to a fuel-air mixture control means of the engine, said comparator circuit receiving from said oxygen sensor an actual value output signal which is compared to a set point value, for generating an output signal which alternates between two discrete states depending on the actual value output signal from said oxygen sensor, said output signal being applied to the fuel-air mixture control means;

an integrating timing circuit, connected to the output of said comparator circuit, said integrating timing circuit being triggered by the output signals from said comparator circuit;

a switching circuit, connected to said integrating timing circuit, said switching circuit being actuated by said integrating timing circuit into a first switching state when said output signal from said comparator alternates in a predetermined manner and actuated into a second switching state when said output signal from said comparator does not alternate in a predetermined manner; and a heater circuit, connected to said switching circuit and a power source for heating said oxygen sensor; whereby said heater circuit is energized when said switching circuit is in its second switching state for a period in excess of that period determined by the time constant of said integrating timing circuit.

2. An apparatus as defined in claim 1, where said switching circuit includes a first transistor, controlled by said integrating timing circuit and a power transistor controlled by said first transistor and disposed in the power supply circuit of said heater circuit.

3. An apparatus as defined in claim 1, wherein said integrating timing circuit includes an input transistor controlled by said comparator circuit and a switching transistor connected between said input transistor and a power supply bus of said integrating timing circuit, and to a rotating engine member, said switching transistor being controlled by rpm-dependent signals deriving from the rotating engine member.

* * * * *